US007815769B2

(12) United States Patent
Hirasawa

(10) Patent No.: US 7,815,769 B2
(45) **Date of Patent: *Oct. 19, 2010**

(54) SANITARY PAPER

(75) Inventor: Akira Hirasawa, Fujinomiya (JP)

(73) Assignee: Daio Paper Corporation, Ehime (JP)

( * ) Notice: Subject to any disclaimer, the term of this patent is extended or adjusted under 35 U.S.C. 154(b) by 147 days.

This patent is subject to a terminal disclaimer.

(21) Appl. No.: 11/973,695

(22) Filed: Oct. 9, 2007

(65) Prior Publication Data

US 2008/0041545 A1 Feb. 21, 2008

Related U.S. Application Data

(62) Division of application No. 10/497,461, filed on Jun. 2, 2004, now Pat. No. 7,300,544.

(51) Int. Cl.
*D21F 11/00* (2006.01)

(52) U.S. Cl. ..... 162/135; 162/158; 162/175; 424/402

(58) Field of Classification Search ..... 162/135, 162/158, 175, 179; 424/402
See application file for complete search history.

(56) References Cited

U.S. PATENT DOCUMENTS 5,935,384 A 8/1999 Taguchi
6,146,648 A 11/2000 Bret et al.

FOREIGN PATENT DOCUMENTS

| | | | |
|---|---|---|---|
| JP | 02-182999 | | 7/1990 |
| JP | 05-098597 | | 4/1993 |
| JP | 3009856 | | 4/1995 |
| JP | 07-216786 | * | 8/1995 |
| JP | H9-154764 | | 6/1997 |
| JP | 10-127750 | | 5/1998 |
| JP | H10-237750 | | 9/1998 |
| JP | 2001-262489 | | 9/2001 |

* cited by examiner

*Primary Examiner*—Mark Halpern
(74) *Attorney, Agent, or Firm*—H. Henry Koda; William L. Androlia

(57) ABSTRACT

It is intended to provide sanitary paper which is excellent in texture such as moistness and softness and scarcely causes skin irritation or blushing even if it is brought into contact with the skin frequently. Namely, sanitary paper having an oil absorbance specified in JIS P8141 of 7 mm or less and a moisture content of from 9.50 to 15.00% (measured in accordance with JIS P8127 after conditioning in accordance with JIS P8111); carrying a solution, which contains a moistening agent, a softener, an antioxidant and so on, coated in a dose of 46.0 to 160.0 mg/cm3 of the paper base; and having a bending hardness B measured with the use of a pure bending machine of from 0.0040 to 0.0060 $g \cdot cm^2/cm$.

7 Claims, 5 Drawing Sheets

(a) PRIOR ART

(b) PRESENT INVENTION

SANITARY PAPER

BACKGROUND OF THE INVENTION

1. Field of the Invention

The present invention is related to sanitary paper such as facial tissues.

2. Description of the Related Art

Recently, so-called luxury type facial tissues have come onto the market which touch softly on the skin by containing a solution such as softener in the tissues. These tissues have become popular as it hardly stings the skin by blowing one's nose, or makes the nose to turn reddish.

However, usual sanitary paper which contains a solution could not prevent the sting and the redness of the skin sufficiently.

Thus, our diligent effort revealed that when usual sanitary paper with a solution touches the corneal surface, the sheet removes the sebum of the surface. Therefore, when the sanitary paper touches the same part of the skin frequently, the sebum will be removed first by the sanitary paper and then, at the place where the sebum was removed, the moisture inside the corneum will be removed. Accordingly, the skin will become rough and will turn reddish.

SUMMARY OF THE INVENTION

The major object of the present invention is to provide sanitary paper which is excellent in touch onto skin such as moistness and softness and which does not sting and make the skin reddish even if the sanitary paper touches the skin frequently.

The above-mentioned object can be attained by the sanitary paper of the present invention which comprises a paper base which contains a solution, in which an oil absorbance is 7.0 mm or less. The oil absorbance mentioned in the present invention is measured, under the standard condition which is regulated by Japanese Industrial Standard P8111 (ISO 0187), according to the Klemm water absorbance test which is regulated by Japanese Industrial Standard P8141, where water is replaced with cooking oil on the market (made by THE NISSHIN OIL MILLS, LTD.). However, measuring time length is 60 seconds and the flow of the paper is longitudinal way (which is the way of manufacturing line flow). That is, a specimen of the sanitary paper is put in a longitudinal way, the lower edge of the paper is dunked into the cooking oil, the height of the rising the cooking oil is measured 60 seconds later and is regarded as the mean value of ten points of the specimen.

Usual sanitary paper, on which a solution was applied, has a character of oil absorption which is too high and, as shown in FIG. 1(*a*), when usual sanitary paper and the skin touch each other frequently, the sebum of corneal surface, and then, the moisture inside the corneum will be removed. As a result, the skin will become rough and will turn reddish.

On the other hand, according to the present invention, when the oil absorbance is 7.0 mm or less, it will be difficult to remove the sebum of corneal surface by a sanitary paper as shown in FIG. 1(*b*), and therefore the moisture inside the corneum will be preserved. As a result, the skin will not become rough or reddish easily.

According to the present invention, sanitary paper is proposed in which a moisture content of the sanitary paper is 9.50 to 15.00%, determined in accordance with Japanese Industrial Standard P8127, after controlling the humidity of the sanitary paper under the condition that is regulated by Japanese Industrial Standard P8111.

The usual product on the market has a low moisture content. Unlike this, the present invention having an elevated moisture content gives an excellent touch onto skin which is realized mainly as a satisfactory moistness. In addition, even if there is not much sebum of corneal surface when the sanitary paper touches the skin, it will be difficult to remove the moisture inside the corneum. Therefore, even if the sanitary paper touches the skin frequently, the skin will not become rough or reddish easily.

According to the sanitary paper of the present invention, it is preferable that the solution content per unit volume of a paper base is 46.0 to 1600.0 mg/cm$^3$. By employing the solution specified above, the oil absorbance of the sanitary paper can be in the range 7.0 mm or less. When the solution content becomes more than 1600.0 mg/cm$^3$, the sanitary paper will show a sticky feeling and will give the users an unpleasant feeling.

According to the sanitary paper of the present invention, the solution is preferably a slightly acid solution that is pH 5.0 to 6.0. By keeping the pH of the solution at a slightly acidic level similar to that of a healthy skin, the skin will not turn into alkaline or strongly acidic even when the sanitary paper touches the skin. Accordingly, it will prevent the skin effectively from being made rough by the pH of the solution.

Further, according to the sanitary paper of the present invention, it is preferable that the solution contains at least one of moisturizers selected from polyhydric alcohols such as glycerin and propylene glycol, or saccharides such as sorbitol and glucose, or glycol-based solvents or derivatives thereof. By using such solutions, the sanitary paper may have a rich moisture and an excellent moistness.

Further, according to the sanitary paper of the present invention, it is preferable that the solution contains at least one of softeners selected from anionic surfactant or nonionic surfactant or cationic surfactant or zwitterionic surfactant. By using such solution, the sanitary paper may have an excellent softness.

Further, according to the sanitary paper of the present invention, it is preferable that the solution contains at least one of antioxidants selected from vitamin C and vitamin E. Vitamin C or vitamin E is suitable for the antioxidant in the present invention. Vitamin E is an ingredient which has a strong reducing force and possesses an antioxidant action such as elimination of activated oxygen-free radical and a prevention of the generation of lipid peroxide. Accordingly, vitamin E will work as a stabilizer of the solution and also when the sanitary paper is given to the skin of the user, it will exhibit an oxidization prevention effect and a circulation of the blood promotion effect onto the sebum of the skin. Vitamin E also possesses a moisture preservation function. On the other hand, vitamin C has an antioxidant action on sebum, as same as vitamin E. As vitamin C acts to reduce vitamin E, when vitamin C and vitamin E both are used together, vitamin C works as a promoter of vitamin E, in which vitamin C reduces the vitamin E which was oxidized by activated oxygen and such, and maintains the strong antioxidant action on sebum of vitamin E.

Further, according to the sanitary paper of the present invention, it is preferable that the solution contains a collagen. 90% of the dermis is formed by collagen and if the collagen decreases, the skin will lose their moisture and fitness. Therefore, by incorporating the collagen into the sanitary paper, moisturizing effect on the ski will be exhibited upon contact with a skin, as well as a moisturizing effect also on the sanitary paper.

Further, according to the sanitary paper of the present invention, it is preferable that the bending hardness B of the sanitary paper is 0.0040 to 0.0060 g·cm$^2$/cm, determined by using a pure bending tester. The bending hardness B of the present invention is described in below. A 20 cm wide paper specimen, having a 1 cm chuck interval, is bended by pure bending way, a bending way which always maintains one side of the paper in an arc. First, bend it toward the front side till the maximum curvature reaches 2.5 cm$^{-1}$ and put it back to the origin, and next, bend it toward the backside till the maximum curvature reaches −2.5 cm$^{-1}$ and put it back to the origin. At this moment, in the relation between curvature and bending moment, the bending hardness B of the present invention is indicated as an average inclination between curvature 0.5 and 1.5 cm$^{-1}$.

The bending hardness B of a usual product on the market is high. On the other hand, when the bending hardness B is reduced according to the present invention, the sanitary paper will be excellent in touch onto skin because of mainly the softness. Moreover, when the paper base is impregnated with moisturizer or softener, there will be an advantage that moistness or softness will be promoted.

Further, according to the sanitary paper of the present invention, it is preferable that the softness per basis weight of the sanitary paper is 5.4 to 6.4 m$^2$/100. As used herein, the term "softness" denotes a value of resistance (a mean value of lengthwise and widthwise values) when a 10 cm wide paper is pushed into a 5.0 mm wide crevice by a terminal. Also, basis weight is a value determined in accordance with Japanese Industrial Standard P8124, The value of softness of usual product on the market was too high. When the value of softness is in the low range according to the present invention, the sanitary paper will be excellent in softness.

Further, according to the sanitary paper of the present invention, it is preferable that the basis weight per 1-ply tissues is 10 to 35 g/m$^2$ and the sanitary paper consists of 1 to 3-ply tissues, a lengthwise tensile strength in a dry condition is 60 to 160 N/m, a crosswise-tensile strength in a dry condition is 20 to 60 N/m, and the ratio of the crosswise tensile strength to the lengthwise tensile strength both in the dry condition is 1.5 to 5.0. The tensile strength of the present invention is, a tensile strength determined by tensile strength testing method which is regulated by Japanese Industrial Standard P8116.

In general, the strength of sanitary paper is reduced when the paper is merely softened. Accordingly, it is preferable that the tensile strength be kept within the range of the present invention.

Further, according to the sanitary paper of the present invention, it is preferable that the NBKP content of pulp material is 30.0 to 80.0%. The present invention is especially suitable for above-mentioned objects when the present invention is sanitary paper specified above.

DESCRIPTION OF THE PREFERRED EMBODIMENTS

Figure 1:
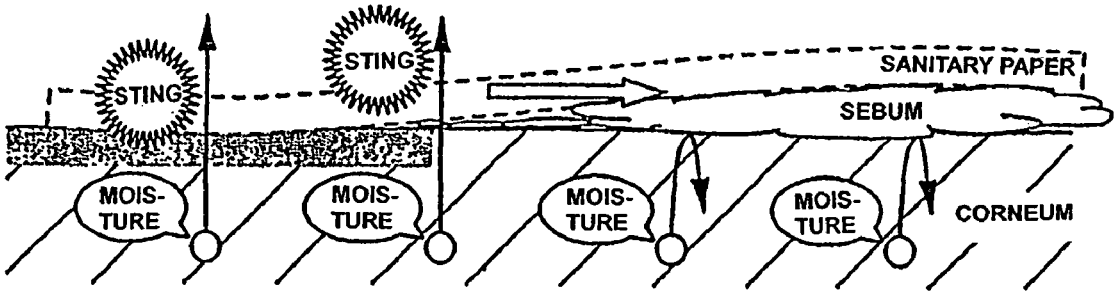
FIG. 1 is a schematic diagram showing a function of sanitary paper containing a solution.
Figure 1:
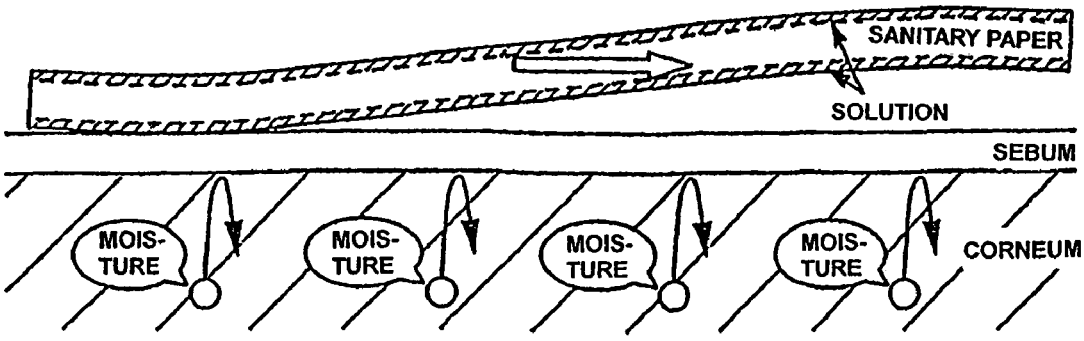

The sanitary paper of the present invention comprises at least one of the basic structures mentioned below, although it is a matter of course that sanitary paper which fulfills the both conditions is more preferred.

The First Basic Structure

A paper base is contained a solution, and the oil absorbance of the sanitary paper is made to be 7.0 mm or less. The oil absorbance of the sanitary paper is measured, under the standard condition which is regulated by Japanese Industrial Standard P8111 (ISO 0187), according to the Klemm water absorbance test which is regulated by Japanese Industrial Standard P8141, where water is replaced with cooking oil on the market (made by THE NISSHIN OIL MILLS, LTD.). The measuring time length is 60 seconds and the flow of the paper is longitudinal (which is the way of manufacturing line flow). That is, a specimen of the sanitary paper is put in a longitudinal position, the lower edge of the paper is dunked into the cooking oil, the height of the rising the cooking oil is measured 60 seconds later and is regarded as the mean value of ten points of the specimen.

The Second Basic Structure

The humidity of sanitary paper is controlled under the condition that is regulated by Japanese Industrial Standard P8111 (ISO 0187) and a moisture content of sanitary paper is 9.50 to 15.00%, determined in accordance with Japanese Industrial Standard P8127 (ISO 0287).

A Typical Structure

In the embodiments of this present invention, the following typical structure can be adopted on above-mentioned basic structure.

As a paper base, publicly noticed product can be used without question. A product-having the softwood bleached kraft pulp (NBKP) content of pulp material is 30.0 to 80.0% (in accordance with Japanese Industrial Standard P8120), especially 50.0 to 70.0%, is suitable as a paper base of the present invention.

The basis weight (determined in accordance with Japanese Industrial Standard P8124) of sanitary paper is preferably 10.0 to 35.0 g/m2. The paper thickness of sanitary paper is preferably 130 to 200 μm by two-ply tissues. The crape rate of sanitary paper is preferably 15.0 to 26.0.

When a solution is contained in a paper base, usually an oil absorbance can be 1.0 to 7.0 mm, and especially 4.0 to 6.5 is preferable. Such sanitary paper can be manufactured by applying the solution onto the paper base (other solution applying methods can also be adopted) while adjusting the amount of the solution content per unit volume of a paper base within 46.0 to 160.0 mg/cm$^3$, especially within 48.0 to 60.0 mg/cm$^3$.

The solution content of the sanitary paper was determined as below. By using a Soxhlet extractor, approximately 10 g of specimen were immersed in 120 to 140 ml of ethanol-benzene solvent (the solvent ratio of ethanol to benzene is 1:1) and were heated and extracted for four hours while keeping the extract liquid lightly boil over a warm bath, and then left to stand in a drier which was held at constant temperature 150±2° C. for 90 minutes and the weight of the extract was measured and the measurement was divided by absolute dry weight of specimen to determine the rate as a percentage %.

The solution content per unit volume of paper (=an amount of the applied solution) was calculated by the next formula.

An amount of the applied solution=basis weight (per ply)×2 (plies)×solution content (%)×1000÷(volume per unit area)

However, a volume per unit area is, paper thickness (μm)÷10000×100×100.

Accordingly, by making the oil absorbance low enough, it will be difficult to remove the sebum of corneal surface by sanitary paper, and therefore the moisture inside the corneum will be preserved by sebum. As a result, the skin will not become rough or reddish easily. Further, when an amount of the solution content becomes more than 160.0 mg/cm$^3$, the sanitary paper will show sticky feeling and will give the users an unpleasant feeling.

For a solution, publicly available product can be used without question. Especially, when a solution is a slightly acid solution of pH 5.0 to 6.0, more suitably of pH 5.3 to 5.7, the skin will not turn into alkaline even when the sanitary paper touches the skin. Accordingly, the skin will be prevented effectively from the roughness which will be caused by an affection of the pH of the solution. The pH adjustment means are to add a pH adjustment solvent, that are acid or basic, into the solution. When the solution is strongly acidic, a sodium hydroxide solution or a potassium hydroxide solution can be added and when the solution is a neutral or an alkaline, a citric acid or a malic acid or a lactic acid can be added.

Ingredients of the solution of the present invention can be chosen suitably from moisturizer, softener and antioxidant. Choosing all of them are specially preferred. For the moisturizer, a polyhydric alcohol, sorbitol and a solvent of glycol series are good for use. By using these moisturizers, the moisture of the sanitary paper will become rich enough. Besides, collagen can be used with these moisturizers, and by this, moisture will be provided onto the skin effectively also.

A softener can be chosen suitably from anionic surfactants, nonionic surfactants, cationic surfactants and zwitterionic surfactants. Especially, an anionic surfactant is suitable. When an anionic surfactant is chosen, the firmness (a hardness of bending) of the paper base will be decreased to the range mentioned above, resulting in a further improvement in the moistness attributable to the moisturizers and the softness attributable to the softeners. As an anionic surfactant, a carboxylate-based, sulfonate-based, sulfate ester salt-based, phosphate ester salt-based surfactant may be employed. An alkyl phosphate ester salt is especially preferred.

As a nonionic surfactant, a polyhydric alcohol monofatty acid ester such as a sorbitan fatty acid ester, diethylene glycol monostearate, diethylene glycol monooleate, glyceryl monostearate, glyceryl monooleate, propylene glycol monostearate, and N-(3-oleyloxy-2-hydroxypropyl)diethanolamine, polyoxyethylene hydrogenated castor oil, polyoxyethylene sorbitol beeswax, polyoxyethylene sorbitan sesquistearate, polyoxy ethylene monooleate, polyoxyethylene monolaurate, polyoxyethylene cetyl ether, polyoxyethylene lauryl ether may be employed.

As a cationic surfactant, a quaternary ammonium salt, amine salt or amine can be used. As a zwitterionic surfactant, a secondary or tertiary amine aliphatic derivative or a heterocyclic secondary or tertiary amine aliphatic derivative carrying a carboxy, sulfonate and sulfate can be employed.

As an antioxidant, vitamin C and vitamin E can be used. When the vitamins are used, the effect of preserving moisture of the sanitary paper and the effect of preventing skin from turning into acid will be exhibited. Especially, when vitamin C and vitamin E both are used together, vitamin C works as a promoter of vitamin E, therefore the antioxidant action of vitamin E can be maintained longer. Vitamin E is an ingredient which has a strong reducing force and possesses an antioxidant action such as elimination of activated oxygen-free radical and a prevention of the generation of lipid peroxide. Accordingly, vitamin E will work as a stabilizer of the solution and also when the sanitary paper is given to the skin of the user, it will exhibit an oxidization prevention effect and a circulation of the blood promotion effect onto the sebum of the skin. Vitamin E also possesses a moisture preservation function. On the other hand, vitamin C has an antioxidant action on sebum, the same as vitamin E. As vitamin C acts to reduce vitamin E, when vitamin C and vitamin E both are used together, vitamin C works as a promoter of vitamin E, whereby reducing the vitamin E once oxidized by the activated oxygen, resulting in the preservation of the strong antioxidant action on sebum of vitamin E.

In addition, a collagen can be added if necessary to exert a moisturizing effect on the skin as well as a moisturizing effect also on the sanitary paper. Although an amount of collagen to be added can be determined suitably, it is preferable that the amount of collagen be as same level as antioxidant on the point of cost-effectiveness.

When using the above-mentioned solution, it is preferable to adopt the following combination.

Active ingredient from 60 to 100% by weight (especially from 80 to 100% by weight)

Moisturizer from 95 to 100% by weight (especially from 95.5 to 97.0% by weight)

Softener from 0 to 5% by weight (especially from 3.0 to 4.5% by weight)

Antioxidant from 0.000001 to 0.001% by weight

Water from 0 to 40% by weight

The moisture content of the sanitary paper of the present invention of 9.50 to 12.00% is especially preferred.

Figure 2:
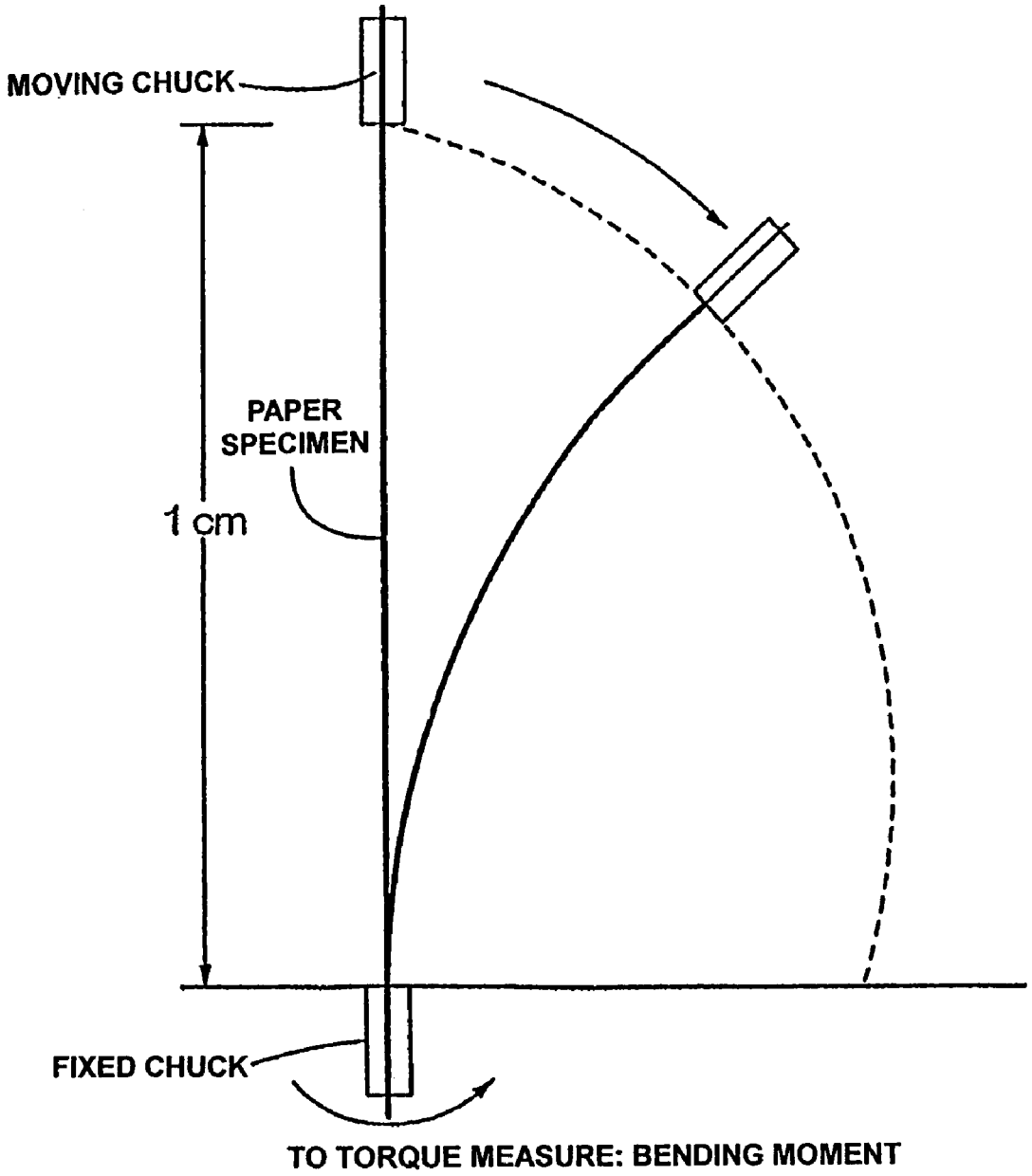
FIG. 2 is a schematic diagram showing a testing method of bending hardness.
Figure 3:
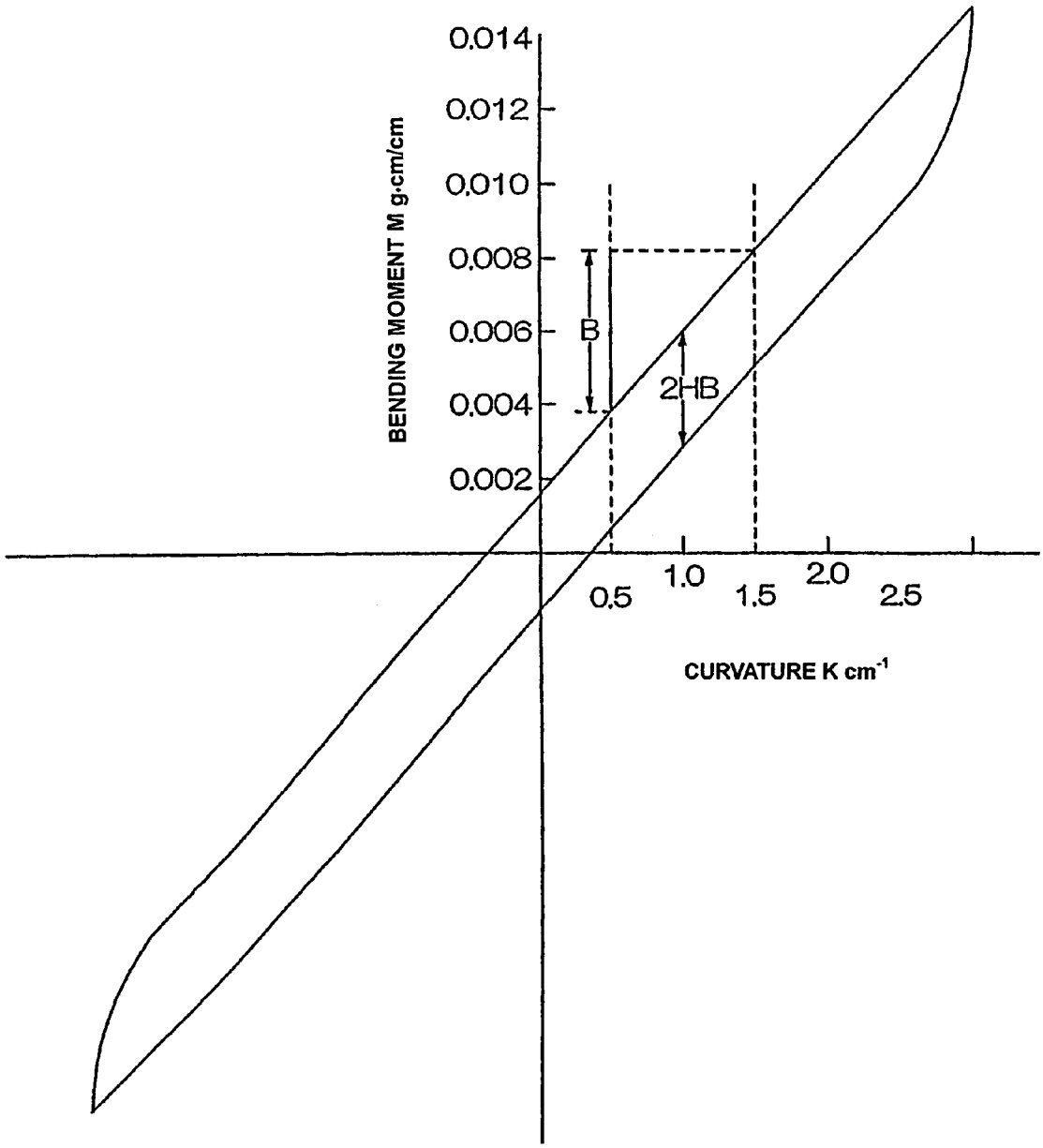
FIG. 3 is a schematic diagram showing a relation between curvature and bending moment.

It is preferable for the sanitary paper of the present invention that the bending hardness B of the sanitary paper is 0.0040 to 0.0060 g·cm$^2$/cm. The bending hardness B of the present invention is determined as below. That is, by using an "Automatic Pure Bending Tester KESFB2-AUTO-A", manufactured by KATO TECH CO., LTD., and as shown in FIG. 2, a 20 cm wide paper specimen, having a 1 cm chuck interval, is bended by pure bending way, a bending way which always maintain one side of the paper an arc. First, bend it toward the front side till the maximum curvature reaches 2.5 cm$^{-1}$ and put it back to the origin, and next, bend it toward the backside till the maximum curvature reaches −2.5 cm$^{-1}$ and put it back to the origin. At this moment, relation between curvature and bending moment is evaluated. This relation is obtained as a value on the Hysteresis curve line as shown in FIG. 3. And the mean value of lengthwise and crosswise of bending hardness B (the mean B), in which the bending hardness B is indicated as an average inclination between curvature 0.5 and 1.5 cm$^{-1}$, is the bending hardness B of the present invention. As the mean value of bending hardness B (the mean B) become higher, the sanitary paper will become firmer and more difficult to bend.

Further, it is preferable for the sanitary paper of the present invention that the softness per basis weight of the sanitary paper is 5.4 to 6.4 m$^2$/100. The "softness" of the present invention is, a value of resistance (a mean value of lengthwise and crosswise) when a 10 cm wide paper is pushed into a 5.0 mm wide crevice by a terminal and it can be measured by the so-called "Handle O Meter".

Further, it is preferable for the sanitary paper of the present invention that the compression characteristic TM, T0 and (T0-TM) is within the next range.

A thickness TM under a 50 g/cm$^2$ load: 0.160 mm or more for 1-ply tissues

A thickness T0 under a 00.5 g/cm$^2$ load: 0.350 mm or less for 1-ply tissues

T0-TM: 0.200 mm or less for 1-ply tissues

TM/(T0-TM): from 0.800 to 1.500

Figure 4:
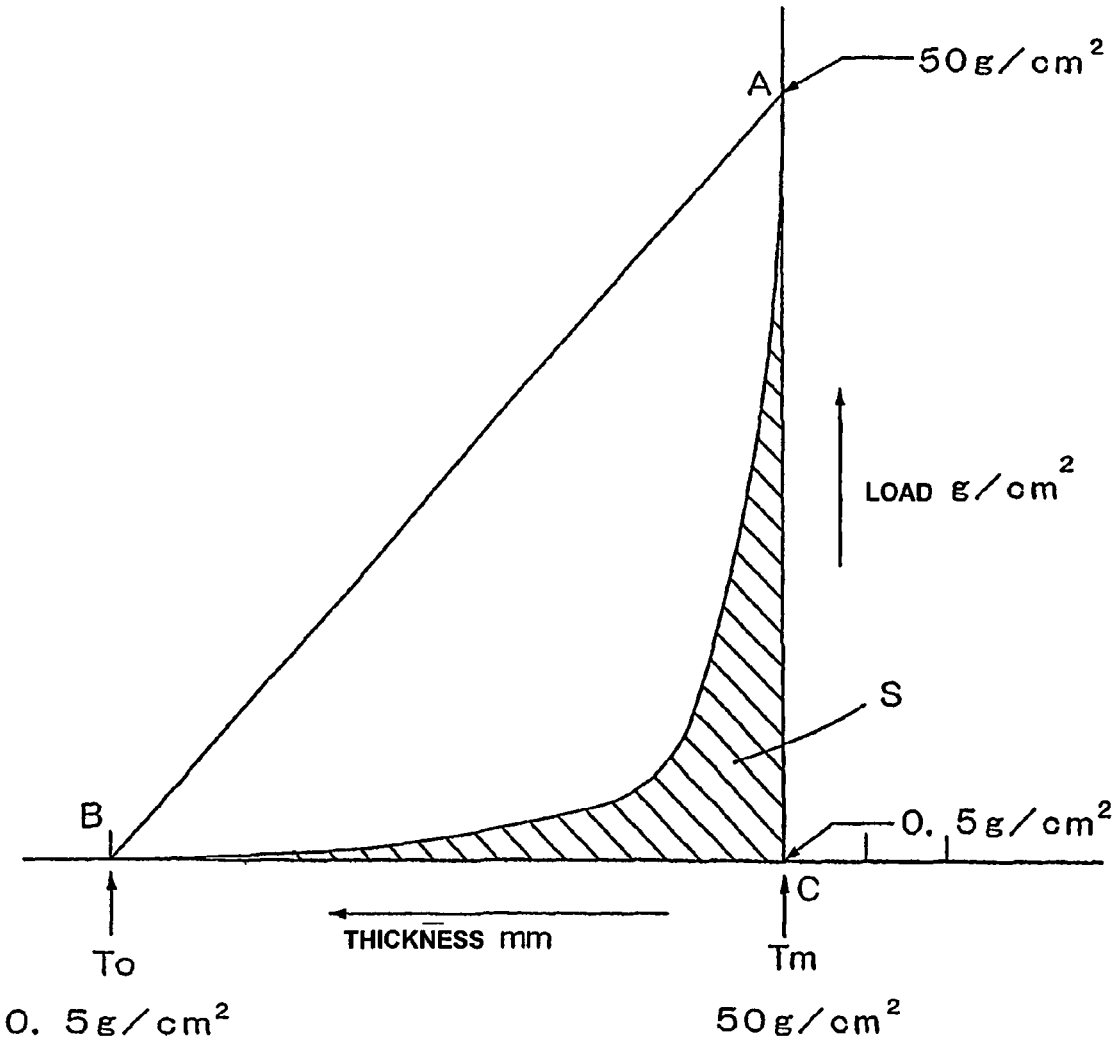
FIG. 4 is a schematic diagram showing a relation of compression characteristic

This compression characteristic test is done by using a "Handy Compression Tester KES-G5", manufactured by KATO TECH CO., LTD. A paper specimen was compressed till the maximum compression load 50 g/cm$^2$ between iron plates, which plate has a circle plane with a 2 cm$^2$ compression area. And the compression characteristic of the paper specimen returning to former state was evaluated. The compression characteristic indicated at this moment, may be described as a relation shown in FIG. 4.

Further, it is preferable for sanitary paper of the present invention whose surface characteristics MMD and MIU are within the following range.

MMD (the mean deviation of friction coefficient): from 0.0180 to 0.0250

MIU (the mean friction coefficient): from 0.4000 to 0.5000

Figure 5:
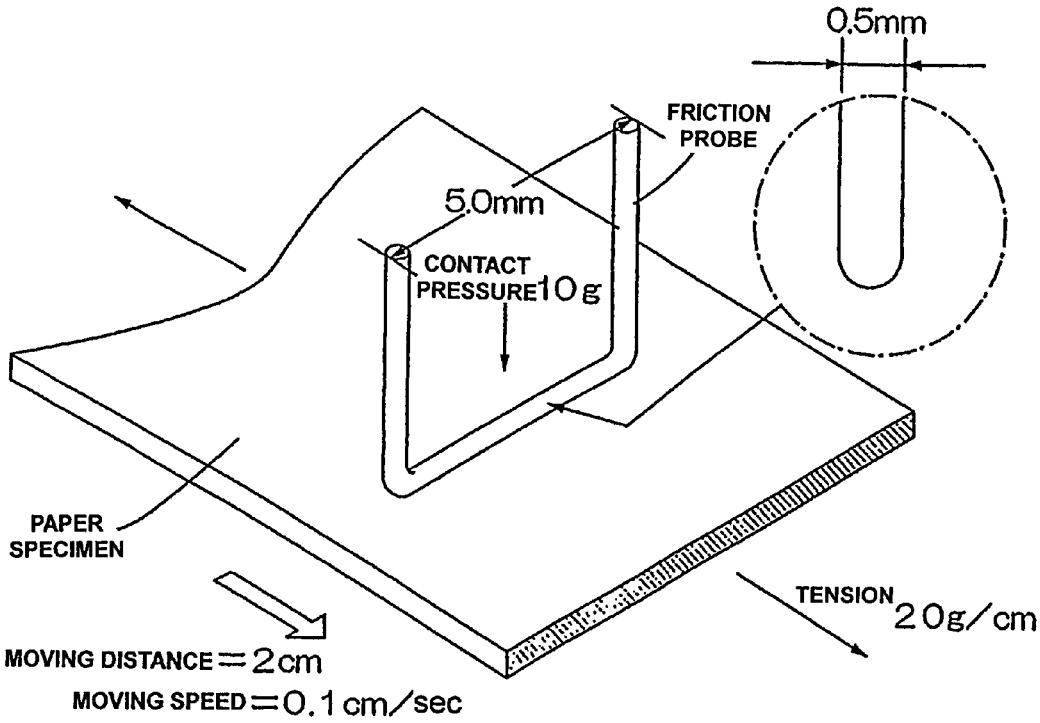
FIG. 5 is a schematic diagram showing a testing method of surface characteristic.

This surface characteristic test is done by using a "Friction Sensitivity Tester KES-SE", manufactured by KATO TECH CO., LTD. This tester, as shown in FIG. 5, measures the friction coefficient as below. While contacting a paper specimen with a friction probe, made by a piano wire which has a cross section with a diameter of 0.5 mm and having a 5 mm-long contacting surface, by touching a 10 g contact pressure, a 20 g/cm tension is applied to the paper specimen in the moving direction and, at the same time, the paper specimen moves 2 cm at a speed of 0.1 cm/sec and the friction coefficient is measured. Furthermore, the mean deviation of friction coefficient MMD is a change of the surface thickness when the friction probe moved, that is, a value of friction coefficient divided by friction distance (the moving distance=2 cm).

On the other hand, the sanitary paper of the present invention is preferable for a product which is used for rubbing the skin such as facial tissue or toilet paper, but also it can be used for other purposes too. When such a purpose has been considered, it is preferable for the sanitary paper of the present invention that the basis weight per 1-ply tissues is 10 to 35 g/m$^2$ and the sanitary paper consists of 1 to 3-ply tissues. Further, it is preferable for the sanitary paper of the present invention that the lengthwise tensile strength in dry condition is 60 to 160 N/m, especially 80 to 140 N/m, crosswise tensile strength in dry condition is 20 to 60 N/m, especially 25 to 40 N/m, and the ratio of the lengthwise tensile strength in dry condition to the crosswise tensile strength in dry condition is 1.5:1.0 to 5.0:1.0, especially 2.0:1.0 to 3.5:1.0. Still more, it is preferable for the sanitary paper of the present invention that the tensile strength in wet condition is, the longitudinal: 30.0 to 60.0 N/m, and the widthwise: 10.0 to 30.0 N/m. When the sanitary paper simply softens, the strength of the paper itself will drop too but by maintaining the tensile strength within such a range, the sanitary paper will become suitable for rubbing skin such as a facial tissue.

Example

As shown in Tables 1 and 2, various physical properties of various facial tissues were measured, calculated and evaluated organoleptically (an example of the present invention, traditional product, and commercial products A, B, C and D). The method of the measurement, calculation and organoleptic evaluation are written below. The measurements of the physical properties were carried out under the conditions that are regulated by Japanese Industrial Standard P8111. Further, the consequence of measurements and such are shown in Table 3.

(1) Basis weight (1-plytissues): measured in accordance with Japanese Industrial Standard P8124.

(2) Paper thickness (2-plytissues): The paper thickness is measured by using a dial thickness gauge "PEACOCK G type" manufactured by OZAKI MFG. CO., LTD. under the conditions that are regulated by Japanese Industrial Standard P8111 ISO 0187). Typically, first check that there is no rubbish or dust between the plunger and the measuring pedestal. Then, put down the plunger on the measuring pedestal, set the dial of the dial thickness gauge at 0, raise the plunger and put the specimen (a facial tissue) onto the pedestal of the tester. And then, put down the plunger slowly and read the gauge. At this moment, merely the plunger is put on the specimen. The measurement is done on one sheet and the mean value of 10 measurements is the paper thickness.

(3) Density: calculated by the next formula.

Basis weight×2/(paper thickness/10000×100×100.

(4) Solution content: as mentioned above.

(5) Solution content per volume unit of the paper: as mentioned above.

(6) Oil absorbance: as mentioned above.

(7) Compound ratio of NBKP: measured in accordance with Japanese Industrial Standard P8120.

(8) Crape rate: calculated by the next formula.

((A circumferential speed of the drier while manufacturing paper)−(Circumferential speed of a reel))/(Circumferential speed of the drier while manufacturing paper)×100

(9) Tensile strength: measured in accordance with Japanese Industrial Standard P8113.

(10) Ratio of a lengthwise tensile strength to a crosswise tensile strength: calculated by next formula.

Lengthwise tensile strength/Crosswise tensile strength

(11) Stretch rate: An elongation at break in a lengthwise tensile strength test.

Moisture content: measured in accordance with Japanese Industrial Standard P8127 (ISO 0287).

(13) Softness: A softness is measured by "Handle O Meter".

(14) Bending hardness B: measured by using a pure bending tester ("Automatic Pure Bending Tester KESFB2-AUTO-A", manufactured by KATO TECH CO., LTD.). Further, as a bending hardness B become higher, the characteristic of facial tissue will become firmer and more difficult to bend.

(15) T0 and Tm: measured by using a compression tester ("Handy Compression Tester KES-G5", manufactured by KATO TECH CO., LTD.). Further, as T0-TM become higher, it shows that the feel of the paper become soft.

(16) Mean friction coefficient MIU and a friction distance MMD: measured by using a surface characteristic tester ("Friction Sensitivity Tester KES-SE", manufactured by KATO TECH CO., LTD.).

(17) Organoleptic evaluation: conducted by blowing one's nose for the designated number of times and scoring how hard to feel pain according to a five-grade system. The values are the mean value of 20 people of men and women.

TABLE 1

| | Example of the present invention | Usual product | Product A on the market | Product B on the market | Product C on the market | Product D on the market |
|---|---|---|---|---|---|---|
| Unit weight ($g/m^2$) | 17.5 | 17.1 | 15.1 | 17.8 | 15.1 | 18.3 |
| Paper Thickness 2-ply tissues (μm) | 160 | 134 | 142 | 163 | 139 | 162 |
| Volume per area unit of the paper ($cm^3/m^2$) | 160 | 134 | 142 | 163 | 139 | 162 |
| Solution content (wt %) | 23.4 | 17.6 | 19.3 | 19.8 | 3.7 | 18.7 |
| Solution content per volume unit of the paper ($mg/cm^3$) | 51.2 | 45.0 | 41.0 | 43.2 | 8.0 | 42.2 |
| Oil absorbance (mm) | 5.5 | 9.0 | 8.3 | 8.0 | 7.6 | 7.2 |
| pH of solution | 5.6 | 6.5 | — | — | — | — |
| NBKP content (wt %) | 60.0 | 60.0 | — | — | — | — |
| Crape rate (%) | 22.0 | 22.0 | — | — | — | — |
| Lengthwise tensile strength in dry condition (N/m) | 83.2 | 184.0 | 133.6 | 86.0 | 141.2 | 86.4 |
| Crosswise tensile strength in dry condition (N/m) | 22.0 | 36.0 | 45.2 | 31.6 | 29.2 | 28.8 |
| Ratio of lengthwise tensile strength to crosswise tensile strength in dry condition | 3.78 | 5.11 | 2.96 | 2.72 | 4.84 | 3.00 |
| Longitudinal stretch rate (%) | 11.7 | 10.9 | 13.1 | 11.8 | 10.5 | 11.7 |
| Lengthwise tensile strength in wet condition (N/m) | 40.4 | 79.6 | 46.8 | 31.6 | 36.0 | 37.6 |
| Crosswise tensile strength in wet condition (N/m) | 12.0 | 18.4 | 19.6 | 14.0 | 9.2 | 15.6 |
| Moisture content (%) | 10.02 | 9.14 | 8.16 | 9.11 | 8.16 | 9.21 |
| Softness (g) | 1.10 | 1.16 | 1.32 | 1.19 | 1.26 | 1.18 |
| Softness/unit weight × 100 ($m^2/100$) | 6.286 | 6.784 | 8.742 | 6.685 | 8.344 | 6.488 |

TABLE 2

| | Example of the present invention | Usual product | Product A on the market | Product B on the market | Product C on the market | Product D on the market |
|---|---|---|---|---|---|---|
| Bending hardness B (gcm2/cm) | 0.0050 | 0.0068 | 0.0095 | 0.0075 | 0.0094 | 0.0062 |
| T0 (mm) | 0.307 | 0.359 | 0.385 | 0.422 | 0.364 | 0.423 |
| Tm (mm) | 0.162 | 0.133 | 0.152 | 0.149 | 0.156 | 0.148 |
| T0 − Tm (mm) | 0.145 | 0.226 | 0.233 | 0.273 | 0.208 | 0.275 |
| Tm/(T0 − Tm) | 1.117 | 0.588 | 0.652 | 0.546 | 0.750 | 0.538 |
| MIU | 0.4373 | 0.4990 | 0.3443 | 0.3879 | 0.2812 | 0.4009 |
| MMD | 0.0239 | 0.0232 | 0.0248 | 0.0199 | 0.0222 | 0.0209 |

TABLE 3

| Organoleptic evaluation | Example of the present invention | Usual product | Product A on the market | Product B on the market | Product C on the market | Product D on the market |
|---|---|---|---|---|---|---|
| The hardness of nose to get painful | 4.63 | 3.00 | 3.13 | 3.23 | 3.13 | 3.45 |
| The feel of moistness | 4.25 | 3.00 | 2.50 | 3.00 | 2.50 | 3.50 |
| The feel of softness | 4.38 | 3.00 | 2.50 | 3.00 | 2.75 | 3.38 |
| The feel of thickness | 4.25 | 3.00 | 3.13 | 3.63 | 3.13 | 3.25 |
| Overall evaluation | 4.38 | 3.13 | 2.25 | 3.00 | 2.38 | 3.38 |

The example according to the present invention has a lower oil absorbance compared to others, so that it will not absorb oil easily, and also has a high solution content and a high moisture content, as shown in Tables 1 to 3, the example acquired remarkably superior result in the Organoleptic evaluation. According to the present invention, the example is a sanitary paper which is excellent in touch onto skin such as moistness and softness and which does not sting and makes the skin red even if the sanitary paper touches the skin frequently.

What is claimed is:

1. Sanitary paper comprising a paper base containing a solution, wherein a moisture content measured in accordance with ISO 0287 is from 9.50 to 15.00%;

humidity conditioning is made in accordance with ISO 0187;

said solution is an anionic surfactant contained as a softener;

a basis weight is 10 to 35 $g/m^2$ per ply; and a bending hardness B measured with use of a pure bending tester is from 0.0040 to 0.0060 $g \cdot cm^2/cm$.

2. The sanitary paper according to claim 1, wherein the solution contains at least one of polyhydric alcohols, saccharides, and glycol-based solvents and derivatives therefrom.

3. The sanitary paper according to claim 1, wherein the solution contains at least one of vitamin C and vitamin E.

4. The sanitary paper according to claim 1, wherein the solution contains collagen.

5. The sanitary paper according to claim 1, wherein softness per unit basis weight of the paper is 5.4 to 6.4 $m^2/100$.

6. The sanitary paper according to claim 1, wherein the paper has a basis weight of 10 to 35 $g/m^2$ per ply and consists of 1 to 3 plies, a lengthwise tensile strength in a dry condition is 60 to 160 N/m, a crosswise tensile strength in a dry condition is 20 to 60 N/m, and the ratio of the crosswise tensile strength to the lengthwise tensile strength both in the dry condition is 1.5 to 5.0.

7. The sanitary paper according to claim 1, wherein the compound ratio of softwood bleached kraft pulp (NBKP) to pulp material is 30.0 to 80.0%.

* * * * *